US005249696A

United States Patent [19]

Bryant et al.

[11] Patent Number: 5,249,696

[45] Date of Patent: Oct. 5, 1993

[54] MANUAL RELIEF GAS VENT

[75] Inventors: Billy W. Bryant, Hixson, Tenn.; Robert E. McCarthy, Fallston, Md.

[73] Assignee: W. R. Grace & Co.-Conn., New York, N.Y.

[21] Appl. No.: 926,990

[22] Filed: Aug. 7, 1992

[51] Int. Cl.[5] ..... B65D 51/16

[52] U.S. Cl. ..... 220/367; 220/231; 220/DIG. 27; 137/312; 137/559; 251/216; 251/225

[58] Field of Search ..... 220/206, 231, 367, 368, 220/DIG. 27, 303; 215/314; 137/312, 551, 559; 251/216, 225

[56] References Cited

U.S. PATENT DOCUMENTS

| | | | |
|---|---|---|---|
| 1,187,769 | 6/1916 | Neal | 220/231 |
| 1,453,299 | 5/1923 | Wetzel | 220/303 |
| 3,208,624 | 9/1965 | Allen | 220/304 |
| 4,424,915 | 1/1984 | Horn | 220/316 |
| 4,688,591 | 8/1987 | Edson | 137/15 |

*Primary Examiner*—Stephen P. Garbe
*Assistant Examiner*—Nova Stucker
*Attorney, Agent, or Firm*—Edward J. Cabic

[57] ABSTRACT

A drum lid for a ventable drum has a depression formed in the surface of the lid. A vent valve is placed in the depression and extends through the lid. The valve has a valve outlet which opens into the reservoir in the lid. During venting the reservoir is filled with water and the valve stem is slowly opened. The gas escapes into the water in the reservoir in the form of bubbles. When the bubbles stop the tank is vented and the lid can be removed.

9 Claims, 2 Drawing Sheets

MANUAL RELIEF GAS VENT

BACKGROUND OF THE INVENTION

1. Field of the Invention

This invention relates to a manual relief gas vent which can be placed in a drum lid to control the pressure in the drum.

2. Description of the Previously Published Art

Various chemical materials have been stored in sealed drums. Some of these materials will produce a gas. After a period of time a gas pressure will build up and a problem develops as to how to safely vent the gas, especially when it is an explosive gas such as hydrogen. For example, when Raney nickel is stored in a sealed drum, there is a tendency for hydrogen gas to be generated which should be vented. When the drum is opened for use, it is necessary to carefully open the drum band and slowly pry up the lid to relieve any gas pressure which may exist inside.

One solution to the problem is to use an automatic relief valve which is spring loaded. It could be set to vent the drum whenever the pressure was above a certain level such as 3 psig. There is an environmental control problem, however, with these valves because there is no way to control the gas coming off. If there are many drums in an unvented storage room on a hot day, the drums will all generate volumes of gas which the valves will automatically vent to the room. There will be no way to prevent the gas from accumulating in the room.

Gas vents have been placed in drums in the past, but these vents extend vertically to some extent such that they extend above the rim of the drum when they are inserted into the bung hole of the drum lid. When the valves extend above the drums, it is not possible to stack the drums one on top of the other.

In U.S. Pat. No. 4,688,591, a relief valve is used inside a cylindrical reducer housing. While effective, this device requires fabricating a cylindrical reducer housing for insertion in the bung hole. The fabrication of such a housing requires many manufacturing steps which add to the expense and the time involved to make the completed lid. Also, because the reducer housing is inserted in the lid cover through a two inch threaded opening, this threaded interface provides an additional region to seal to prevent possible leaking.

3. Objects of the Invention

It is an object of this invention to have a valve assembly for a drum which is compact and which fits in a depression in the drum lid so that it does not extend above the height of the drum rim.

It is a further object of this invention to have a manually operated gas relief valve which can be safely operated to vent even explosive gases from a sealed drum, while providing a positive seal when such venting is prohibited.

It is a further object of this invention to provide a sealed drum with a simplified cover and with better cover integrity.

It is a further object of this invention to have a less expensive ventable drum cover by using a less costly reducer valve which can be simply made and quickly inserted into a drum cover.

It is a further object of this invention to have a valve assembly for a drum where the valve outlet is protectively positioned in a reservoir within the drum lid.

It is a further object of this invention to have a valve assembly where the valve outlet discharges into a reservoir which can be filled with water or other inert fluid to visually detect the flow of gas from the outlet as the gas bubbles into the reservoir.

These and further objects will become apparent as the description of the invention proceeds.

SUMMARY OF THE INVENTION

An improved drum lid for a ventable drum has been developed. The lid is a conventional lid adapted for attachment to a drum having an upper side and a lower side. A novel feature is the provision of a depression in the surface of the lid with a bottom surface which forms a reservoir. A vent valve is mounted on the bottom surface of the reservoir and the valve extends through the bottom surface of the reservoir (i.e. through the lid) and it is secured to the lid on the other side. The valve is made of a valve stem housing which extends through the lid and it has a valve outlet on the upper portion of the housing which opens into the reservoir in the lid. A fastener, such as a nut, on the lower side of the lid to engages the extended portion of the valve stem housing to secure the valve to the lid. A further feature is a seal positioned around the valve stem housing to provide a liquid tight seal between the valve stem housing and the lid. In the preferred embodiment this is a metal washer on the upper side of the lid. A rotatable valve stem in the valve stem housing allows control of the flow of fluid within the drum through the valve stem housing and out the valve outlet.

A protective cap can be placed over the drum valve assembly to keep out foreign matter and freezing liquids and the valve is preferably made of a spark resistant material. During the venting operation, the reservoir can be filled with an inert fluid such as water. When the valve stem is slowly opened, the operator can visually confirm that a gas such as hydrogen is venting out by watching the bubbles of vented gas rising up to the liquid surface. After the gas has vented out, the lid can be removed from the drum.

DESCRIPTION OF THE PREFERRED EMBODIMENTS

Figure 1:
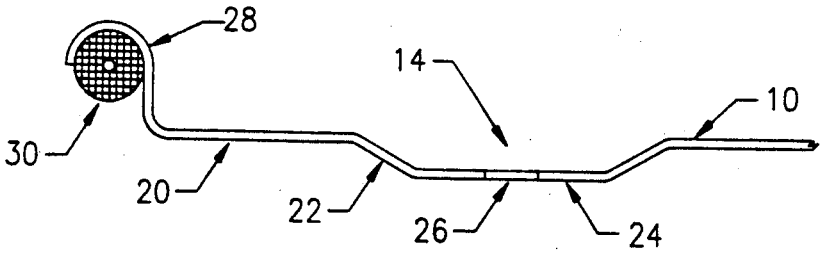
FIG. 1 illustrates a cross-sectional view of a portion of the lid showing the reservoir without the valve inserted.

A preferred embodiment is illustrated in the figures. The drum lid 10 shown in FIG. 1 has a bung opening with a cap 12 and a reservoir 14 in the drum lid into which is inserted the relief valve 16.

Figure 2:
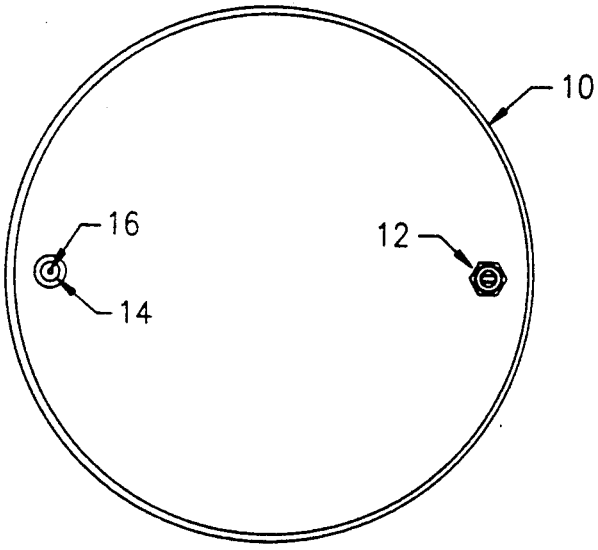
FIG. 2 illustrates a top view of the drum lid.

FIG. 2 provides a side view of the lid 20 showing the depression 14 formed by side walls 22 and the bottom surface 24. Opening 26 in the bottom of the reservoir is where the valve will be mounted. The lid had a lip 28 with a gasket 30 inside the curl of the lip.

Figure 3:
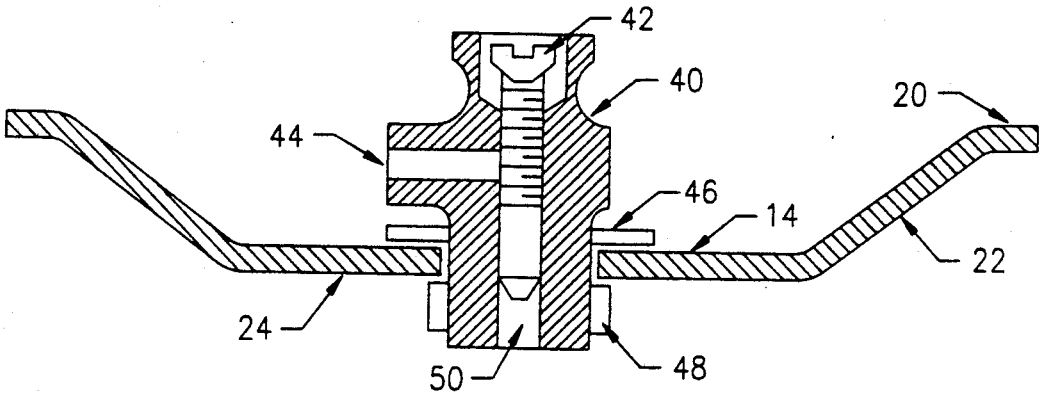
FIG. 3 illustrates a cross-sectional view of the lid and the drum valve assembly.

The valve housing 40 is illustrated in FIG. 3 and is preferably a standard, commercially available valve assembly which is inserted into the central opening 26. It is secured to the lid by a fastening nut 48 on the underside. A washer seal 46 is placed between the housing and the lid to prevent leakage. Preferably a further gas tight sealant is applied between the threads of the fastening nut and the threads on the bottom of the valve assembly and more preferably a liquid thread sealant is used. The upper portion of the valve housing 40 has the valve stem 42 therein and a valve opening 44 which opens into the reservoir 14. The valve housing is preferably made of a spark resistant material with nickel plated brass being particularly preferred. Other valve housings could be used without outside threads provided that sufficient engagement means are provided to secure the valve housing in the central opening.

An optional weather cap 60 (not shown) made out of a plastic or rubber material can be inserted over the reservoir to protect the valve stem and the valve outlet in the reservoir from freezing liquid or foreign matter. The cap can fit over the top of the housing.

Figure 4:
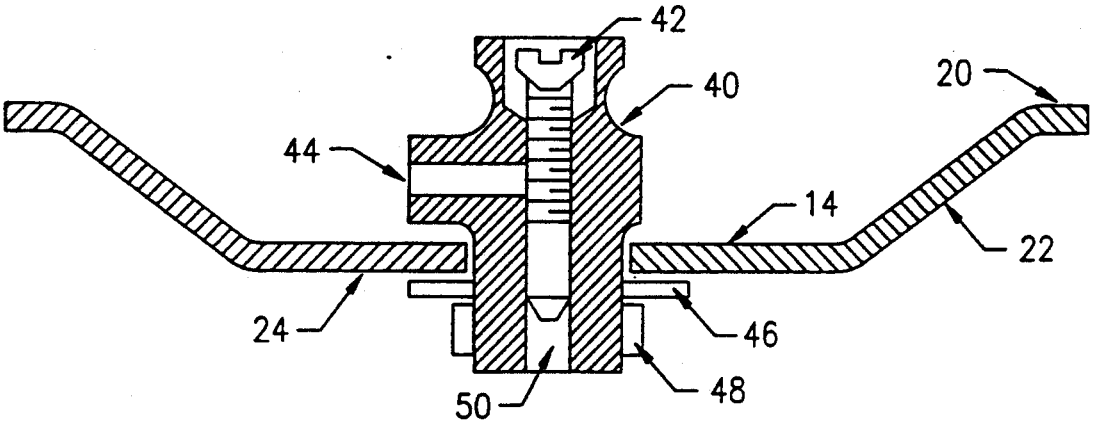
FIG. 4 illustrates a cross-sectional view of another embodiment of the lid and drum assembly.

To assemble the lid, the valve assembly is inserted into the opening in reservoir of the drum lid. A seal is provided between the valve assembly and the opening in the lid. The seal can be in the form of a washer which can be placed on either side of the lid. In FIG. 3 it is placed on the upper side and in FIG. 4 it is placed on the lower side. Preferably the washer is a metal washer since this has been found to provide the best seal. A fastening nut is threaded on to the bottom of the valve stem assembly and the nut is tightened to provide a secure seal. In a preferred embodiment a gas tight seal along the threads can be made by applying a sealant. Preferably a liquid thread sealant can be used such as Loctite RE/620, a retaining compound made by Loctite Corp. or its equivalent When it is desired to check or vent the drum, the reservoir 14 may be filled with water or some other inert fluid. Should there be gas under pressure in the drum, then when the valve stem is slightly opened the small venting of the gas will be very readily seen by the bubbles of gas coming up through the water or other inert fluid. The operator can continue to either vent the gas or else close the valve stem to maintain the gas under pressure in the drum.

When it is desired to slowly vent the drum, the operator can open the stem valve and determine how much gas is coming out by observing how many bubbles are flowing up through the reservoir.

A further feature of the system is that it provides a positive indication that the drum is in a neutral condition. If there is water in the reservoir and the valve stem is completely removed, then if the water flows down into the drum the operator knows that there is no gas pressure in the drum and that the valve opening into the drum is not plugged. With this assurance that the drum is in a neutral condition, the operator can then proceed to safely open the drum lid.

The valve assembly with the liquid thread sealant has been successfully tested on a drum. It met the Department of Transportation's 6B Drum Specification (Section 178.98) for impact testing and pressure testing. Because the valve stem is recessed in the depression in the lid and is lower than the outer drum ring, it will not be harmed when the drum tips over or when another drum is placed on top of the first drum.

The arrangement of the components of the drum valve assembly permit a variety of tools to access the parts so that the unit can be easily assembled.

It is understood that the foregoing detailed description is given merely by way of illustration and that many variations may be made therein without departing from the spirit of this invention.

What is claimed is:

1. An improved drum lid for a ventable drum comprising a lid adapted for attachment to the drum having an upper side and a lower side;

a depression in the upper side of the lid forming a reservoir and having a bottom surface, said depression formed unitarily in the lid; and a valve mounted on the bottom surface of the reservoir and extending through the bottom surface of the reservoir, a valve stem housing extending through the lid and having a valve outlet on the upper portion of the housing which opens into the reservoir in the lid;

fastening means to secure the valve stem housing to the lid;

seal means positioned around the valve stem housing to provide a liquid tight seal between the valve stem housing and the lid; and a valve stem in the valve stem housing to control the flow of fluid through the valve stem housing and out the valve outlet.

2. A drum lid according to claim 1, wherein the seal means is a washer.

3. A drum lid according to claim 2, wherein the washer is a metal washer.

4. A drum lid according to claim 1, further comprising a bung opening in the drum lid.

5. A drum lid according to claim 1, wherein the seal means is a washer positioned on top of the lid.

6. A drum lid according to claim 1, wherein the seal means is a washer positioned on bottom of the lid.

7. A drum lid according to claim 1, wherein the fastening means is positioned on the lower side of the lid to engage the extended portion of the valve stem housing.

8. A drum lid according to claim 7, wherein the fastening means is a nut.

9. A method for venting a drum comprising sealing the drum with a drum lid according to claim 1, adding an inert liquid to the reservoir, and opening the valve stem to let the gas escape as bubbles through the liquid.

* * * * *